United States Patent [19]

Tsuge

[11] Patent Number: 4,871,640

[45] Date of Patent: Oct. 3, 1989

[54] METHOD FOR PRODUCING AN ORIGINAL FOR USE IN AN OVERHEAD PROJECTOR

[75] Inventor: Shoichi Tsuge, Osaka, Japan

[73] Assignee: Minolta Camera Kabushiki Kaisha, Osaka, Japan

[21] Appl. No.: 193,276

[22] Filed: May 11, 1988

[30] Foreign Application Priority Data

May 15, 1987 [JP] Japan ..... 62-119750
May 30, 1987 [JP] Japan ..... 62-136992

[51] Int. Cl.[4] ..... G03G 13/22

[52] U.S. Cl. ..... 430/126; 430/31; 430/120; 427/25; 427/195; 428/152; 428/155; 428/907.7

[58] Field of Search ..... 430/31, 41, 120, 126; 427/195, 25; 428/152, 155, 907.7

[56] References Cited

U.S. PATENT DOCUMENTS

| | | | |
|---|---|---|---|
| 3,196,765 | 7/1965 | Walkup | 430/120 X |
| 3,266,045 | 8/1966 | Schaffert | 430/31 X |
| 3,510,297 | 5/1970 | Herrick et al. | 430/31 X |
| 4,082,549 | 4/1978 | Haas et al. | 430/41 |
| 4,549,803 | 10/1985 | Ohno et al. | 355/14 FU |

FOREIGN PATENT DOCUMENTS

| | | | |
|---|---|---|---|
| WO79/00999 | 11/1979 | European Pat. Off. | 427/195 |

OTHER PUBLICATIONS

Kay, "Electrophotographic Development of Negative Images", IBM Tech. Discl. Bull., vol. 7, No. 12, May 1965, p. 1198.

"Journal of Applied Photographic Engineering", SPSE Oct. 1982, vol. 8, No. 5.

*Primary Examiner*—Roland E. Martin

*Attorney, Agent, or Firm*—Wenderoth, Lind & Ponack

[57] ABSTRACT

Disclosed is a method for producing an original for use in an overhead projector through an electrophotographic process. The method comprises a process for applying a first light-transmissive toner onto a surface of a transparent film, a process for heat-fixing the first light-transmissive toner on the film so that particles of the first light-transmissive toner are not melted completely and such that a diffusive surface is formed, a process for applying a second light-transmissive toner onto the diffusive surface corresponding to a document image, and a process for heat-fixing the toner image on the diffusive surface so that particles of the second light-transmissive toner forming the toner image are melted completely and that a toner image having a smooth surface is formed. When such films carrying toner images having a smooth surface formed on the diffusive surface are piled one over another, the toner images on the lower films placed under the top film are invisible through the top film and hence the toner image on the top film is clearly visible.

6 Claims, 3 Drawing Sheets

FIG. 2
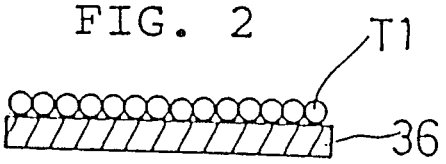
FIG. 3
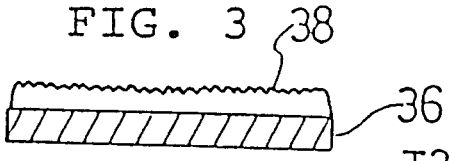
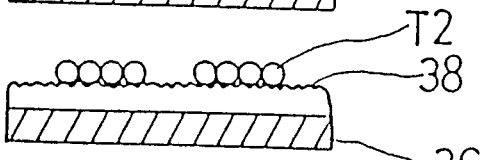
FIG. 4
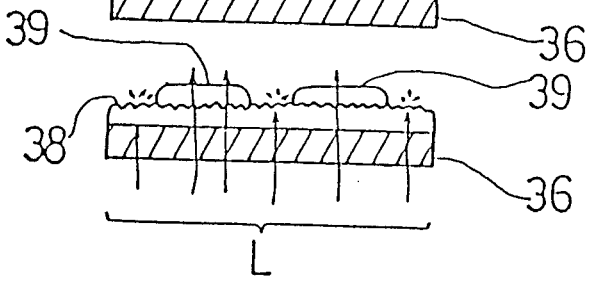
FIG. 5
FIG. 6
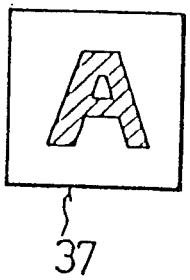
FIG. 7
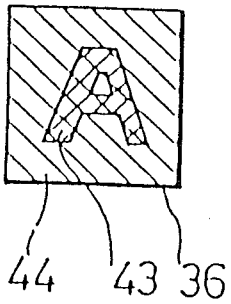
FIG. 8
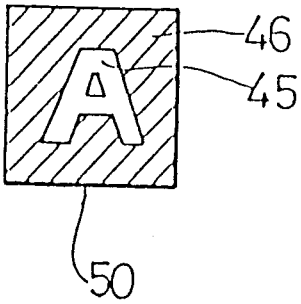

METHOD FOR PRODUCING AN ORIGINAL FOR USE IN AN OVERHEAD PROJECTOR

BACKGROUND OF THE INVENTION

1. Field of the Invention

The present invention relates to a method for producing an original for use in an overhead projector (hereinafter abbreviated to "OHP") and, more specifically, to a method for producing an original directly from a document by using an electrophotographic copying machine.

2. Description of the Prior Art

Transparent films carrying positive images have generally been used for projection. When such transparent films are placed in a pile, it is difficult to read the positive image formed on the top transparent film because the contents of the lower transparent films are visible through the top transparent film. Opaque white papers and the transparent films are placed alternately one over another to enable reading the contents of the individual transparent films, which makes handling the transparent films very troublesome.

A method has been proposed for preparing films carrying highly visible negative images for projection by using an electrophotographic copying machine. This known method, however, requires troublesome work to convert a positive image of an original document into a corresponding negative image and to transfer the negative image to a film for projection by an electrophotographic copying machine.

SUMMARY OF THE INVENTION

Accordingly, it is an object of the present invention to provide a simple method for producing an original for use in an OHP.

It is another object of the present invention to provide a method for easily producing highly visible original for use in OHP by using an electrophotographic copying machine.

In one aspect of the present invention, a method for producing an original for use in an OHP from a document through an electrophotographic process, comprising: a first process for applying a first light-transmissive toner onto one of surfaces of a transparent film; a second process for producing a diffusive surface on said one of surfaces of said transparent film by fixing the layer of the first light-transmissive toner to the transparent film; a third process for applying a second light-transmissive toner onto said diffusive surface corresponding to an image on the document; and a fourth process for forming an image portion having a smooth surface corresponding to said document image by fixing said second light-transmissive toner on said diffusive surface.

The image portion having a smooth surface can be formed by an electrophotographic copying machine. However, the smooth image may be formed by any suitable method; for example, the smooth image may be formed by a writing tool for writing or drawing with an adhesive ink, by applying a fusible ink onto the diffusive surface and by heating the fusible ink to melt the fusible ink, by spraying an adhesive ink onto the diffusive, or by adhesively attaching transparent films or tapes onto the diffusive surface.

In accordance with the present invention, a diffusive surface is formed on one of the surfaces of a transparent film for use in an OHP (hereinafter referred to as "OHP film"), and then a smooth image corresponding to an image to be projected is formed on the diffusive surface. When the transparent OHP film carrying the smooth image is illuminated by a projection light source to project the image on a screen, the light emitted from the light source and transmitted through the smooth image forms a highlighted image on the screen while the light emitted from the light source toward areas other than the smooth image is diffused to form shadows on the screen as a background for the highlighted image.

According to the present invention, an original carrying a negative image can be formed directly from a positive image of a document, for example, by using an electrophotographic copying machine through a simple procedure. The film prepared through the present invention carries a image formed on a diffusive reflecting surface, and hence the image is clearly visible before the diffusive reflecting surface even if a plurality of such films are placed one over another. Thus, the present invention facilitates the OHP projection operation remarkably.

BRIEF DESCRIPTION OF THE DRAWINGS

The above and other objects, features and advantages of the present invention will become apparent from the following description taken in conjunction with the accompanying drawings, in which:

FIGS. 2, 3, 4 and 5 are schematic sectional views explaining the method of the present invention, showing different stages of the method, in which:

FIG. 2 is a schematic sectional view of a first step of the method of the present invention;

FIG. 3 is a schematic sectional view of a second step of the method of the present invention;

FIG. 4 is a schematic sectional view of a third step of the method of the present invention; and FIG. 5 is a schematic sectional view of a fourth step of the method of the present invention;

FIG. 6 is an illustration of a document carrying a positive image;

FIG. 7 is an illustration of an OHP film carrying a negative image corresponding to the positive image of FIG. 6;

FIG. 8 is an illustration of an image displayed upon a screen by projecting the negative image of Fig.7;

FIGS. 10 and 11 are schematic sectional views explaining a process of forming a smooth image on the OHP film of FIG. 9, in which:

FIG. 10 is a schematic sectional view of a step of applying a light-transmissive toner to an OHP film in a second embodiment of the present invention; and FIG. 11 is a schematic sectional view of a step of fixing the light-transmissive toner on the OHP film of the second embodiment of the present invention.

DESCRIPTION OF THE PREFERRED EMBODIMENTS

Prior to the description of an image forming, an electrophotographic copying machine employed in forming an image according to the present invention will be described with reference to FIG. 1 by way of an example.

Figure 1:
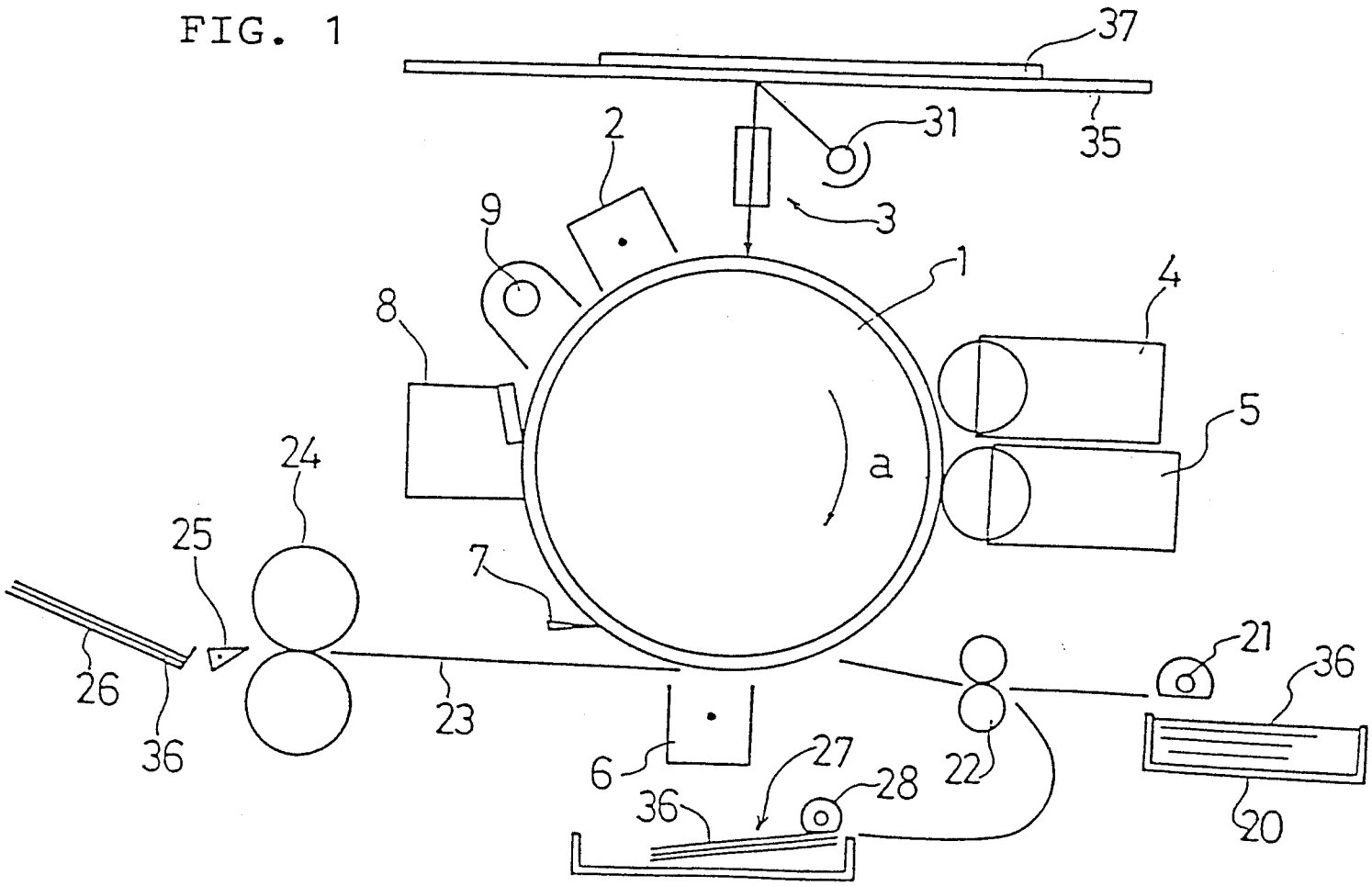
FIG. 1 is a schematic sectional view of an electrophotographic copying machine employed in a method for producing an original for use in an OHP, in a preferred embodiment, according to the present invention.

Referring to FIG. 1, the electrophotographic copying machine has a photosensitive drum 1 which rotates in the direction of an arrow "a", a first developing unit 4 disposed near the circumference of the photosensitive drum 1, and a second developing unit 5 disposed near the circumference of the photosensitive drum 1 and after the first developing unit 4. The first developing unit 4 forms a diffusive surface on an OHP film by using a first developer, namely, a mixture of a carrier and a light-transmissive toner having a high viscosity. The second developing unit 5 develops a latent image formed on the drum 1, by using a second developer, namely, a mixture of a carrier and a light-transmissive toner having a low viscosity, to form an image having a smooth surface (hereinafter referred to as "smooth image"). The rest of the components, including a charger 2, an exposure unit 3 having an exposure lamp 31, a transfer charger 6, a separator 7, a cleaning unit 8, a eraser lamp 9, a automatic film feed cassette 20, a feed roller 21, a pair of timing rollers 22, a guide plate 23, a fixing unit 24 of a heat-fixing type, a delivery guide 25, a tray 26, a refeed unit 27, a refeed roller 28, a contact glass 35 and a cover 37, are the same in construction and function as those of the conventional electrophotographic copying machine, and hence the description thereof will be omitted.

The method embodying the present invention for producing an original for use in an OHP, comprises a diffusive surface forming process and a smooth image forming process.

DIFFUSIVE LAYER FORMING PROCESS

The electrophotographic copying machine is started to perform the diffusive surface forming process. The photosensitive drum 1 is rotated in the direction of the arrow "a" and the circumference of the photosensitive drum 1 is charged by the charger 2 at a fixed potential.

The first developing unit 4 applies the first developer to the circumference of the drum 1. The first developer is prepared in the following manner.

Composition of a high-viscosity light-transmissive toner T1:

styrene-acrylate copolymer ($45\times10^5$poise at 100° C.) 100 parts by weight

Offset inhibitor 5 parts by weight

Charge control agent 5 parts by weight

A mixture of the foregoing materials is mixed well by a mixer, and then the mixture is kneaded and cooled to solidify the mixture. Then, the solid mixture is crushed by a crusher into coarse particles. Then, the coarse particles are pulverized by a jet pulverizer into fine particles. The fine particles are classified to select a particles having particle sizes in the range of 4 to 20 μm to obtain a toner having an average particle size of 11 μm.

Then, the toner T1 and a carrier having an average particle size of 35 μm are mixed to obtain the first developer. The carrier is a binder type magnetic carrier in which a magnetic powder is dispersed in a stylene-acrylic resin.

In the image forming cycle, the second developing unit 5 is held inoperative by a control unit, not shown, which is the same procedure as that used for forming a multicolor image with an ordinary multicolor copying machine, and the exposure lamp 31 is not lighted to hold the exposure unit 3 inoperative. Consequently, the high-viscosity light-transmissive toner T1 is applied onto the entire area on the circumference of the photosensitive drum 1. The high-viscosity toner T1 is transferred to a transparent OHP film 36 fed out of the automatic film feed cassette 20 by the agency of the transfer charger 6 as shown in FIG. 2.

Then, the high-viscosity toner T1 is fixed to the transparent film 36 by the fixing unit 24 including a teflon upper roller and a silicon rubber roller. The fixing conditions of the fixing unit 24 are determined so that the high-viscosity toner T1 will not be melted completely and a diffusive surface 38 of the high-viscosity toner T1 is formed as shown in FIG. 3. In this case, the fixing temperature is 180° C. and the fixing speed is 100 mm/sec. The transparent film 36 carrying the diffusive surface 38 of the high-viscosity toner T1 is delivered to the refeed unit 27 for temporary storage. The transparent film 36 is refed for the smooth image forming process to form a smooth image on the diffusive surface 38 of the high-viscosity toner T1 in the next image forming cycle.

(SMOOTH IMAGE FORMING PROCESS)

The circumference of the photosensitive drum 1 is charged at a predetermined potential by the charger 2, and is exposed with light to form an electrostatic latent image of a document placed on the contact glass 35. The electrostatic latent image is developed by the second developing unit 5 accommodating the second developer which includes a low-viscosity toner T2. During the second image forming cycle, the first developing unit 4 is held inoperative by the control unit.

The second developer is prepared in the following manner.

Composition of the low-viscosity light-transmissive toner T2.

styrene-acrylate copolymer ($0.4\times10^5$ poise at 100°C.) 100 parts by weight Offset inhibitor 5 parts by weight Charge control agent 5 parts by weight A mixture of the foregoing materials is processed in the same process as that for preparing the high-viscosity toner T1 to obtain the solid low-viscosity toner T2, and then the solid low-viscosity toner T2 is pulverized into particles having particle sizes in the range of 4 to 20 μm. Then, the particles are classified to obtain the low-viscosity toner T2 having an average particle size of 11 μm. Then, the pulverized low-viscosity toner T2 and a carrier having an average particle size of 35 μm are mixed to obtain the second developer. The carrier is a binder type magnetic carrier in which a magnetic powder is dispersed in a stylene-acrylic resin.

The transparent film 36 carrying the diffusive surface 38 of the high-viscosity toner T1 and stored in the refeed unit 27 is fed to a transfer position between the photosensitive drum 1 and the transfer charger 6 by the refeed roller 28 and the pair of timing rollers 22 in timed relation with the photosensitive drum 1. The image formed by the low-viscosity toner T2 is transferred onto the diffusive surface 38 of the high-viscosity toner T1 by the agency of the transfer charger 6 as shown in FIG. 4.

The low-viscosity toner image is fixed by the fixing unit 24 at a fixing temperature of 180° C. and a fixing speed of 100 mm/sec., at which the low-viscosity toner T2 is melted completely, to form a smooth image 39 as shown in FIG. 5.

As shown in FIG. 5, light L projected from behind the transparent film 36 travels straight through the smooth negative image 39 to reach a screen, while the light L is diffused by the diffusive surface 38 and is unable to reach the screen.

When a positive image 37 of a document shown in FIG. 6 is copied on an OHP film 36 by the method of the present invention, a smooth image 43 formed of the low-viscosity toner T2 is formed on a background 44 formed of the diffusive surface 38 of the high-viscosity toner T1 as shown in FIG. 7. When the OHP film 36 carrying the smooth image 43 and the background 44 is mounted on an OHP and projected on a screen, the smooth image is displayed in a highlighted image 45 and the background 44 is displayed in a shaded background 46 on the screen 50 as shown in FIG. 8. Thus, the smooth image can be formed simply on the OHP film from a positive image of a document by using an electrophotographic copy machine. Since the smooth image is formed on the diffusive surface which intercepts the light, the image formed on the OHP film is visible, which facilitates the OHP operation remarkably.

The smooth image 39 may not necessarily be formed through an electrophotographic copying process; the smooth image 39 may be formed by any suitable means such as a pen using an ink capable of forming a smooth image 39 on the diffusive surface 38.

Although this embodiment uses different toners, namely, the high-viscosity toner and the low-viscosity toner, respectively for forming the diffusive surface and the smooth image, different toners differing from each other in particle size may be used instead of the high-viscosity toner and the low-viscosity toner.

Furthermore, toners of the same properties may be used for forming the diffusive surface and the smooth image and fixing conditions, such as fixing temperature, fixing pressure and/or fixing time, may be varied for forming the diffusive layer and for forming the smooth image.

A method for producing an original for use in an OHP, in a second embodiment, according to the present invention uses an OHP film originally having a diffusive surface. This method eliminates the diffusive surface forming process of the method in the first embodiment.

Figure 9:
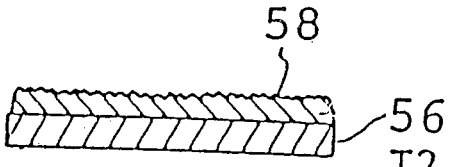
FIG. 9 is a schematic sectional view of an OHP film for use in a second embodiment of the present invention.

Referring to FIG. 9, an OHP film 56 for use in the second embodiment of the present invention originally has a diffusive surface 58. One of the surfaces of the transparent OHP film 56 is sandblasted to form the diffusive surface 58 having roughness of 12.5 μm in average pitch and 5.8 μm in average peak-to-valley height. It is preferable that the average pitch and the average peak-to-valley height be the half of the toner's average particle size or less to form the smooth image 39 effectively. The diffusive surface 58 may be formed through any suitable process such as an etching process or an embossing process.

Figure 10:
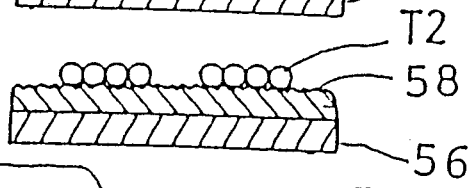
Figure 11:
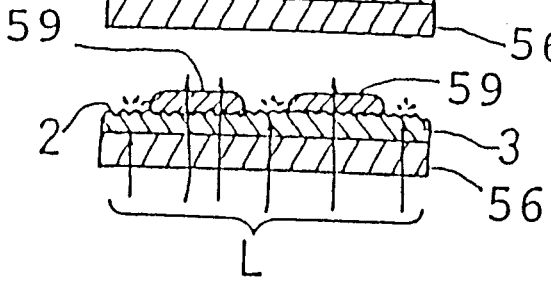

A smooth negative image 59 is formed on the diffusive surface 58 of the OHP film 56 as shown in FIGS. 10 and 11 through the same process as that for forming the smooth image 39 in the first embodiment. However, it is done in this second embodiment in a single copying cycle with the same electrophotographic copying machine by using the developing unit 5 which develops an image by using the low-viscosity toner T2.

Thus, the second embodiment further simplifies the preparation of an OHP film carrying the negative image.

Although the invention has been described in its preferred forms with a certain degree of particularity, obviously many changes and variations are possible therein. It is therefore to be understood that the present invention may be practiced otherwise than specifically described herein without departing from the scope and spirit thereof.

What is claimed is:

1. A method of producing an image film for use in an overhead projector from a document, the method comprising:

providing a transparent film, a first light-transmissive toner, and a second light transmissive toner;

a first process applying a uniform layer of said first light-transmissive toner onto one surface of said transparent film;

a second process producing a diffusive surface on said surface of said transparent film by fixing said uniform layer of said first light-transmissive toner onto said transparent film;

a third process applying said second light-transmissive onto said diffusive surface so as to correspond to an image on said document; and a fourth process forming an image portion having a smooth surface corresponding to said image on said document by fixing said light transmissive toner on said diffusive surface.

2. The method of producing an image film as set forth in claim 1, wherein said first process comprises the steps of:

providing a photosensitive member and a first light-transmissive toner developing unit, said first light-transmissive toner developing unit accommodating said first light-transmissive toner therein;

charging a surface of said photosensitive member uniformly at a predetermined potential;

supplying a uniform layer of said first light-transmissive toner from said first light-transmissive toner developing unit to the charged surface of said photosensitive member; and transferring said first light transmissive toner from said surface of said photosensitive member onto the entire area of said surface of said transparent film.

3. The method of producing an image film as set forth in claim 1, wherein said third process comprises the steps of:

providing a photosensitive member and a second light-transmissive toner developing unit, said second light-transmissive toner unit accommodating said second light-transmissive toner therein;

charging a surface of said photosensitive member at a predetermined potential;

exposing the charged surface of said photosensitive member so as to form an electrostatic latent image on said surface of said photosensitive member corresponding to said image on said document;

developing said electrostatic latent image on said surface of said photosensitive member by transferring said second light-transmissive toner from said second light-transmissive toner unit to said surface of photosensitive member; and transferring said second light-transmissive toner from said surface of said photosensitive member onto said diffusive surface.

4. The method of producing a image film as set forth in claim 1, wherein:

said second process comprises providing a heat roller and heating said first light-transmissive toner with said heat roller to fix said uniform layer of said first light-transmissive toner onto said transparent film; and said fourth process comprises heating said second light-transmissive toner with said heat roller to fix said second light-transmissive toner onto said diffusive surface.

5. The method of producing an image film as set forth in claim 4, wherein:

said first light-transmissive toner and said second light-transmissive toner are provided such that said first light-transmissive toner has a higher viscosity than said second light-transmissive toner at the temperature at which said first and second light-transmissive toners are fixed.

6. A method for forming a diffusive surface on a surface of a transparent film, comprising the steps of:

providing a transparent film, a light-transmissive toner, and a photosensitive member;

charging the surface of said photosensitive member uniformly at a predetermined potential;

applying a uniform layer of said light-transmissive toner to the charged surface of said photosensitive member;

transferring said light-transmissive toner from said surface of photosensitive member onto a surface of said transparent film; and fixing said light-transmissive toner onto said transparent film by heating said light-transmissive toner so as to partially and incompletely melt said light-transmissive toner.

* * * * *